United States Patent [19]

Hough

[11] 3,968,527

[45] July 13, 1976

[54] PERIMETER OVERFLOW SYSTEM FOR SWIMMING POOLS

[76] Inventor: William D. Hough, 2611 Poinsettia Drive, McKeesport, Pa. 15131

[22] Filed: May 21, 1975

[21] Appl. No.: 579,314

[52] U.S. Cl. ..... 4/172.17; 210/169

[51] Int. Cl.[2] ..... E04H 3/16; E04H 3/18; F16L 21/02

[58] Field of Search ..... 4/172, 172.17, 172.18, 4/172.21, 172.15, 172.19; 210/169

[56] References Cited

UNITED STATES PATENTS

| | | | |
|---|---|---|---|
| 3,319,264 | 5/1967 | Scarano | 4/172.17 |
| 3,391,790 | 7/1968 | Lerner | 210/169 |
| 3,432,867 | 3/1969 | Whitten, Jr. | 4/172.17 |
| 3,443,263 | 5/1969 | Minasy | 4/172.19 |
| 3,490,081 | 1/1970 | Ogden | 4/172.17 |
| 3,537,111 | 11/1970 | Whitten, Jr. | 4/172.17 |
| 3,641,594 | 2/1972 | Hough | 4/172.17 |
| 3,668,712 | 6/1972 | Baker | 4/172.17 |

*Primary Examiner*—Henry K. Artis

*Attorney, Agent, or Firm*—Brown, Murray, Flick & Peckham

[57] ABSTRACT

A gutter system for a swimming pool of the type having side walls and a gutter extending along the top of the side walls around the periphery of the swimming pool, characterized in that the gutter is formed from integral sections molded from non-metallic material and joined end-to-end by flexible, water-tight gaskets. Each integral gutter section has a front wall facing the swimming pool, a bottom wall resting on the top of the side walls of the swimming pool, and a back wall which preferably has a vertical extension thereon rising above the gutter and forming a break-water between the gutter and an elevated concrete deck. Slotted, removable cover sections are fitted over the gutter and extend between the upper edge of the front wall of the gutter and an integral flange formed on the back wall of the gutter. Advantageously, a water supply conduit is disposed in the gutter beneath the cover sections and is connected to water nozzle assemblies extending through the front wall of the gutter which feed water into the pool.

9 Claims, 5 Drawing Figures

PERIMETER OVERFLOW SYSTEM FOR SWIMMING POOLS

BACKGROUND OF THE INVENTION

In U.S. Pat. No. 3,641,594, a swimming pool construction is described of the type having cast concrete walls, together with a gutter cast into the top of the walls and surrounding the upper periphery of the swimming pool. This gutter is necessary to skim off surface water which contains most of the contaminants in the pool such as bacteria, oil and debris. Slotted, removable cover sections are fitted over the gutter, which sections are formed from plastic or concrete material and are preferably not necessarily provided with integral seating lugs which fit into the cavity and hold the sections in place. A water supply conduit can be disposed within the gutter beneath the cover sections but above a drain at the bottom of the gutter whereby debris or other material in the drain will not collect around the water supply conduit. The water supply conduit, in turn, is removably connected by quick-disconnect couplings to water nozzle assemblies which feed water into the pool. Normally, a vertical wall is provided above the slotted cover sections behind the gutter to provide a break-water. This vertical wall terminates at a concrete or the like deck surrounding the swimming pool.

While the system shown in the aforesaid U.S. Pat. No. 3,641,594 constitutes an advance in the art and is entirely satisfactory, a cast concrete gutter and wall structure behind the gutter requires considerable concrete formwork and is relatively expensive. Systems such as that shown in Whitten, Jr. U.S. Pat. No. 3,432,867 have been provided wherein the gutter is formed in sections having an integral vertical wall which acts as a break-water. The difficulty with the gutter system shown in the aforesaid Whitten, Jr. patent, however, is that the gutter is formed from stainless steel, an extremely expensive material; and its installation is also extremely expensive by virtue of the fact that it requires welding of the roll-formed stainless steel sections end-to-end in situ by scarce, highly-trained welders. Furthermore, it is subject to corrosion by the chloride ion present in swimming pools, is expensive to ship because of its weight and can be hazardous if it is not properly grounded.

SUMMARY OF THE INVENTION

In accordance with the present invention, a swimming pool construction is provided having a gutter extending around the upper periphery of the pool but wherein the gutter, instead of being cast into the concrete side walls, is formed in sections from non-metallic material which are fastened end-to-end to the top of a concrete wall forming the main body of the swimming pool. In certain embodiments of the invention, the gutter sections have formed integrally therewith an upstanding back vertical wall which extends from the top of the gutter and is terminated at a concrete deck or the like surrounding the swimming pool. As in previous gutter constructions, slotted, removable cover sections are fitted over the gutter which carries a water supply conduit and has supply nozzles extending through the front wall thereof. With this construction, water will be skimmed off the top of the pool, passing through the slotted cover sections and into the gutter to a drain, the aforesaid back vertical wall formed integrally with the gutter sections keeping the water from flowing onto the surrounding deck or between the deck and outside pool wall.

Specifically, there is provided in accordance with the invention a new and improved swimming pool construction including integral gutter sections each having a front wall facing the swimming pool, a bottom wall resting on top of the side walls of the swimming pool, and a back wall. An integral flange is formed in each of the gutter sections at the top of the aforesaid back wall of the gutter section. This serves to support one edge of the removable cover sections, the other edges of which are supported by the front wall of the gutter. Flexible gasket devices are utilized to secure the gutter sections end-to-end. The gutter sections can be secured to the top of a concrete wall of the swimming pool by means of nylon or other non-metallic fasteners and/or a mastic cement.

The gutter sections, in contrast to those formed from stainless steel, are not subject to corrosion, can be installed by semi-skilled labor and less costly to ship because of their lower weight.

The above and other objects and features of the invention will become apparent from the following detailed description taken in connection with the accompanying drawings which form a part of this specification, and in which.

Figure 1:
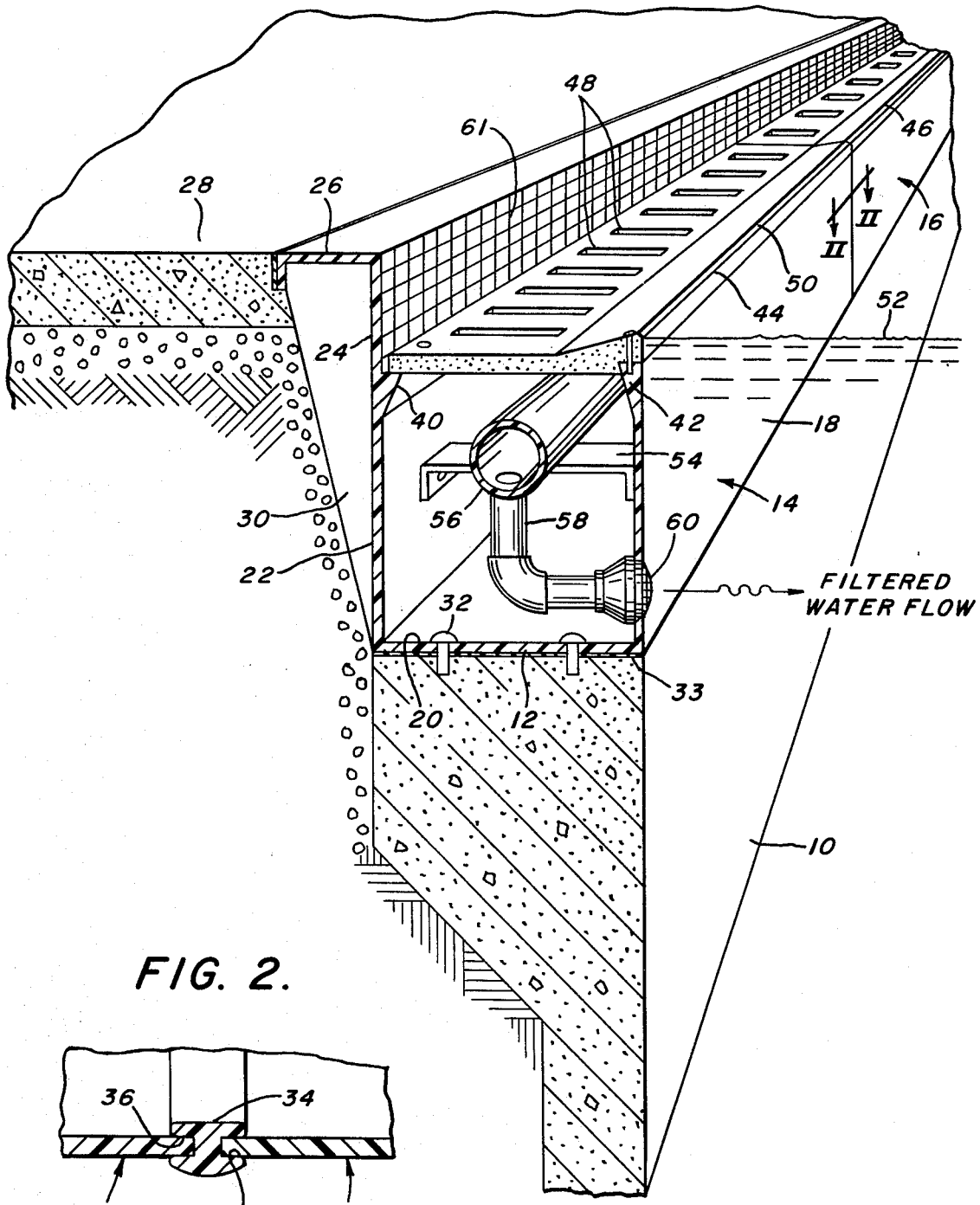
FIG. 1 is a broken-away perspective view of one embodiment of the gutter system of the invention.

With reference now to the drawings, and particularly to FIG. 1, the swimming pool construction shown includes a cast concrete wall 10 which forms the major portion of the side wall of the swimming pool. As will be understood, the wall 10 extends around the entire periphery of a swimming pool and is provided with an upper supporting surface 12 on which the gutter sections of the invention are supported. The gutter system of the invention comprises molded, plastic sections, two of which are shown in FIG. 1 and identified by the reference numerals 14 and 16. Each section is provided with a front wall 18, a bottom wall 20 which rests on the upper surface 12 of the side wall 10, and a back wall 22. Integrally formed with the back wall 22 is an upper vertical wall 24 which terminates in a horizontal flange 26 which may be flush with a concrete deck 28 surrounding the swimming pool. Alternatively, other arrangements can be used such as, for example, a concrete deck whose forward edge overlies the flange 26 or which extends beyond the flange in a cantilever arrangement. If desired or necessary, gussets 30 may be added to each gutter section 14, 16, etc. between the back wall 22, the upper vertical wall 24 and the flange 26 to give added strength. When installing the gutter system of the invention, the side walls 10 will initially be poured. Thereafter, the sections 14 and 16, etc. forming an entire gutter around the periphery of the pool can be secured to the upper surface 12 by means of nylon or other non-metallic fasteners 32 and/or a mastic cement or other grouting material 33.

The gutter sections 14 and 16 are preferably made from fiberglass fibers in a matrix of polyester resin, or some other suitable resin, and formed into the desired cross section by extrusion or pulltrusion. In certain cases, the vertical wall 24 and flange 26 may be eliminated in which case the top of the deck 28 will be flush with the top of the back wall 22. When the vertical wall 24 and flange 26 are used, they are formed integrally with the remainder of the gutter section in a pulltrusion or extrusion process, for example.

In place of fiberglass fibers in a resin matrix, the gutter sections can also be formed by molding any of the well-known plastic, non-metallic materials. As used in the claims which follow, the term "plastic" includes the fiberglass construction described above.

Figure 2:
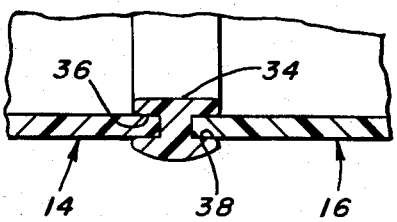
FIG. 2 is a cross-sectional view taken along line II—II of FIG. 1 showing the manner in which gaskets are utilized to join the gutter sections of the invention end-to-end.

The manner in which the successive sections 14, 16, etc. are secured end-to-end is shown in FIG. 2. A generally H-shaped flexible gasket 34 is provided between the adjacent edges of the sections 14 and 16, for example. The gasket 34 may be formed from neoprene, polypropylene, polyurethane or any other similar plastic material which has a degree of plasticity and is provided with grooves 36 and 38 into which opposite edges of two adjacent sections 14 and 16 are inserted. In installing the sections of the gutter, it is necessary only to snap the gaskets over the facing edges of succeeding sections.

It will be noted that there is formed integrally between the back wall 22 and the vertical wall 24 an inwardly-extending flange or support angle 40. A similar flange or support angle 42 is formed on the upper edge of the front wall 18. Spanning the distance between the flanges 40 and 42 is a plurality of removable, precast slotted overflow gutter caps, two of which are shown in FIG. 1 and identified by the reference numerals 44 and 46. The gutter caps 44 and 46 are preferably formed from a plastic material such as fiberglass. Spaced along the gutter caps are slots 48 which, of course, permit water to flow over a forward lip or weir 50 of the gutter caps and through the slots 48 into the gutter itself. The normal pool water level is indicated in FIG. 1 by the line 52; and it will be appreciated that water will flow over the lip 50 and through the slots 48 into the gutter itself.

Spanning the distance between the forward wall 18 of the gutter and the back wall 22 are supports 54. Only one such support is shown in FIG. 1; however it will be appreciated that such supports are spaced along the entire gutter assembly. Carried on the supports 54 is a water supply conduit 56 connected through a conduit 58 to a filter water supply nozzle 60 extending through the forward wall 18. While only one supply conduit 58 and nozzle 60 are shown in FIG. 1, it will be appreciated that they are spaced along the length of the gutter around the entire periphery of the pool. The removable cover sections 44 may be removed to expose the conduits 56, 58 and nozzles 60 for repair as required. The front face of the vertical wall may have ceramic tile 61 secured thereto by a mastic cement or the like. If the gutter is molded from plastic, scribed lines may be provided in the mold to simulate a tile pattern or a tile pattern of plastic material can be applied to the front face of vertical wall 24.

Figure 3:
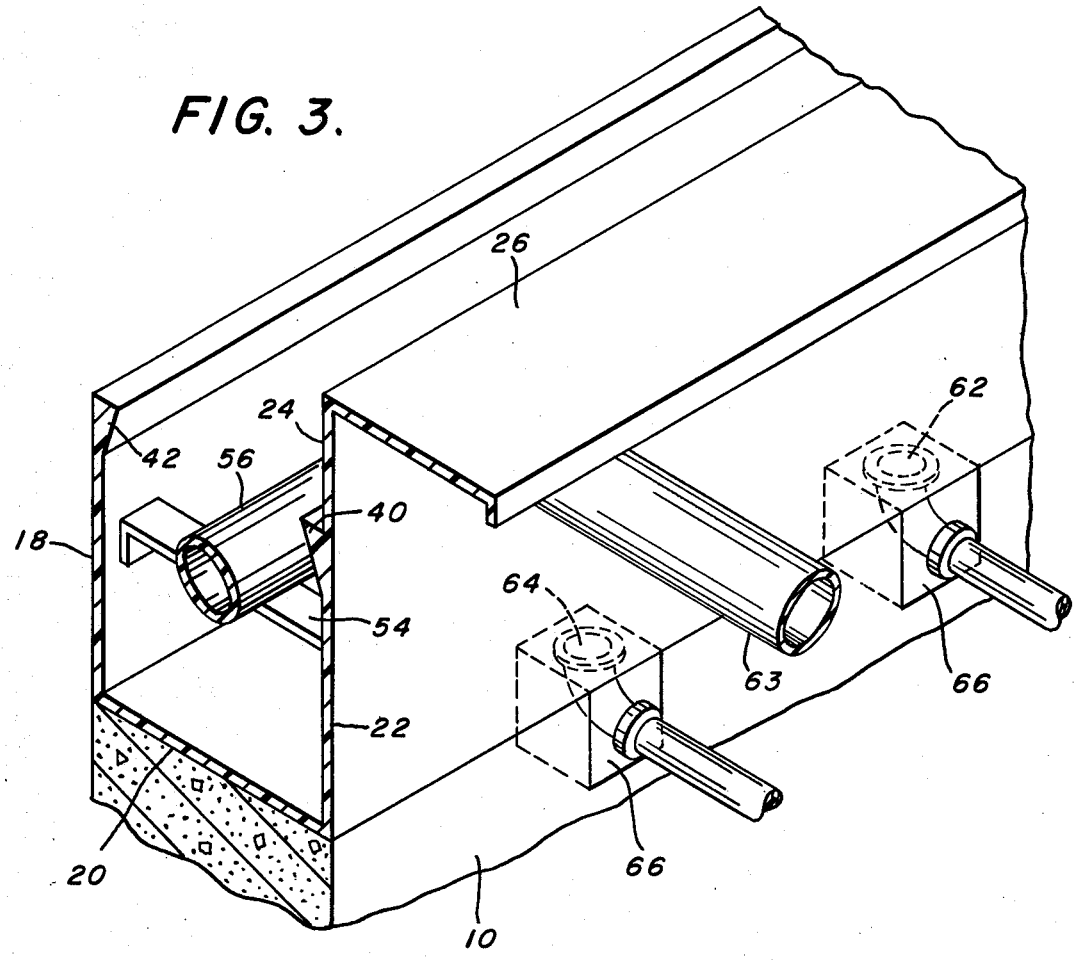
FIG. 3 is a rear view of the gutter system of the invention.

In FIG. 3, a rear view of the gutter assembly is shown. Filtered water is supplied to the water supply conduit 56 within the gutter by means of a pipe 63 which extends through the back wall 22. Drains 62 and 64 are provided in recesses 66 cast in the concrete wall 10. Thus, the water which is skimmed off the pool and which flows through the slots 48 in the gutter caps 44 passes through the drains 62 and 64 back to a filtering plant, not shown.

Figure 4:
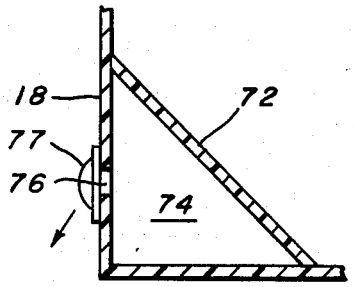
FIGS. 4 and 5 are cross-sectional views showing alternative arrangements for providing a water supply conduit within the gutter system of the invention.
Figure 5:
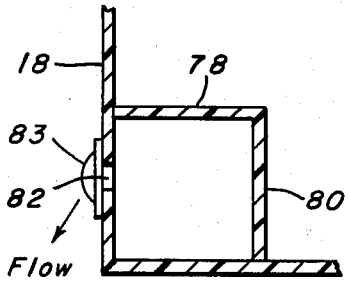

Instead of using the water supply conduits such as conduit 56 shown in FIGS. 1 and 3, it is also possible to form the conduit integrally with the gutter itself. Arrangements of this type are shown in FIGS. 4 and 5. In FIG. 4, an arrangement is shown wherein a slanted partition 72 forms a cavity 74 connected to a water supply line, not shown. Spaced ports 76 provided with directional fittings 77 are formed in the front wall 18 to permit water to flow into the pool. In FIG. 5, still another arrangement is shown wherein walls 78 and 80 form a square pipe which conveys filtered water to the pool through spaced ports 82 and fittings 83 in the front wall 18.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. In a swimming pool construction of the type having side walls, and a gutter extending along the top of the side walls around the periphery of the swimming pool; the improvement in said swimming pool construction wherein said gutter is formed in sections of non-metallic plastic material joined end-to-end by pliable gaskets and mounted on top of said side wall, each of said gutter sections having a front wall facing said swimming pool, a bottom wall resting on the top of the side walls of said swimming pool, and a back wall, the front, bottom and back walls being integrally formed.

2. The improvement of claim 1 wherein the back wall of each gutter section has an integral vertical extension thereon rising above the gutter and forming a vertical wall.

3. The improvement of claim 2 in which said vertical wall has formed thereon an integral horizontal flange which contacts a deck extending around the periphery of the swimming pool.

4. The improvement of claim 3 including gussets between said vertical wall and said integral horizontal flange.

5. The improvement of claim 1 wherein said gaskets are H-shaped in cross section.

6. The improvement of claim 1 including a plurality of removable cover sections fitted over said gutter and extending between the top of the front wall of the gutter sections and said back wall thereof.

7. The improvement of claim 6 including an integral flange formed in said back wall for receiving edges of said removable cover sections.

8. The improvement of claim 1 including means for fastening said gutter sections to the top of the side wall of said swimming pool.

9. The improvement of claim 1 including a water supply conduit carried within said gutter above the bottom thereof, the bottom of said gutter forming a drain chamber, the nozzle assemblies extending through the front wall of the gutter and connected at spaced points to said water supply conduit.

* * * * *